US007309374B2

(12) United States Patent
Singh et al.

(10) Patent No.: US 7,309,374 B2
(45) Date of Patent: Dec. 18, 2007

(54) DIFFUSION BONDED NICKEL-COPPER POWDER METALLURGY POWDER

(75) Inventors: Tajpreet Singh, Burlington (CA); Scott Thomas Campbell, Milton (CA); Thomas Francis Stephenson, Toronto (CA); Ouan Min Yang, Mississauga (CA)

(73) Assignee: Inco Limited, Toronto (CA)

( * ) Notice: Subject to any disclaimer, the term of this patent is extended or adjusted under 35 U.S.C. 154(b) by 43 days.

(21) Appl. No.: 11/098,693

(22) Filed: Apr. 4, 2005

(65) Prior Publication Data

US 2006/0222554 A1 Oct. 5, 2006

(51) Int. Cl.
*B22F 1/00* (2006.01)
*B22F 3/12* (2006.01)
*B22F 9/04* (2006.01)

(52) U.S. Cl. ..... 75/255; 75/351; 75/369; 148/513; 419/31; 419/36; 419/38; 428/570

(58) Field of Classification Search ..... 75/351, 75/369, 255; 148/513; 419/31, 36, 38; 428/570
See application file for complete search history.

(56) References Cited

U.S. PATENT DOCUMENTS

| | | | | |
|---|---|---|---|---|
| 2,853,403 | A * | 9/1958 | Bryan et al. | 427/216 |
| 3,494,747 | A * | 2/1970 | Burr | 75/246 |
| 3,832,156 | A * | 8/1974 | Wilson et al. | 75/356 |
| 4,238,221 | A * | 12/1980 | Sevensson | 75/352 |
| 4,483,905 | A | 11/1984 | Engström | 428/570 |
| 4,834,800 | A | 5/1989 | Semel | 106/403 |
| 5,069,714 | A | 12/1991 | Gosselin | 75/252 |
| 6,068,813 | A | 5/2000 | Semel | 419/66 |
| 2003/0103858 | A1 * | 6/2003 | Baran et al. | 419/30 |

FOREIGN PATENT DOCUMENTS

| | | |
|---|---|---|
| GB | 1162702 | 9/1966 |
| GB | 1162702 | 8/1969 |

OTHER PUBLICATIONS

W. Brian James, "Ferrous Powders—How Alloying Method Influences Sintering", MPIF Sintering Seminar, Pittsburgh, Oct. 1991.
T. Singh et al., "Nickel-Copper Interactions in P/M Steels", Metal Powder Industries Federation, Dec. 2004.

* cited by examiner

*Primary Examiner*—Roy King
*Assistant Examiner*—Ngoclan T. Mai
(74) *Attorney, Agent, or Firm*—Edward A. Steen

(57) ABSTRACT

In contrast to current industrial practice where alloying powders are added to starting powder metallurgy compositions either as powder mixtures or fully prealloyed powders, the present invention posits a diffusion bonded nickel-copper precursor additive mixture for direct one step addition to the starting powder metallurgy master blend composition. Segregation and dusting are substantially reduced and the mechanical properties of the resultant compact are improved.

35 Claims, No Drawings

DIFFUSION BONDED NICKEL-COPPER POWDER METALLURGY POWDER

TECHNICAL FIELD

The present invention relates to alloying elements in powder metallurgy ("P/M") steels in general and to a diffusion-bonded nickel-copper precursor powder additive for P/M steels and related compositions in particular.

BACKGROUND OF THE INVENTION

Copper and nickel are two of the most commonly used alloying elements in P/M steels. Copper hardens and strengthens steels. It melts during the sintering process and thus relatively coarse copper powders can be used in the steel without impairing mechanical properties. Finer copper powders are desirable in P/M. However, the cost is generally too high for the benefit obtained. Nickel also adds hardness and strength to the steel while providing it with good ductility properties. Because coarse copper powders can be used the cost of adding copper is low compared to nickel. The addition of nickel is made via the use of finer powders since nickel does not melt during sintering. Finer powders permit a better distribution via solid-state diffusion.

The liquid phase sintering of copper has a negative effect in steel since it causes the P/M part to swell. The dimensional swelling of parts containing copper can be quite high causing them to go out of specifications and also lose density. Parts makers often add nickel to copper-containing steel, because the nickel causes densification, which counteracts the swelling caused by the copper.

Alloying powders are generally added to steel master powders (typically iron plus carbon) in two ways: either as admixed powders or as fully pre-alloyed powders. Admixed powders are prepared by mixing the iron or steel powder with the desired alloying element(s) in elementary form. The fully prealloyed steel powders are manufactured by atomizing a steel melt containing the desired composition of alloying elements to a powder. Hybrid powders combine these two alloying methods whereby prealloyed iron powders are admixed with alloy powders.

Admixed powders have a major disadvantage over prealloyed powders because they are prone to: a) segregation (due to the non-uniform composition of components) during transportation and processing; and b) dusting during handling. The former undesirable phenomenon of segregation occurs because the powders consist of particles that often differ considerably in size, shape and density and are not physically interconnected. Thus admixed powders are susceptible to segregation during their transport and handling. This segregation leads to varying compositions of green compacts manufactured from the admixed powders and thus to varying dimensional changes during the subsequent sintering operation and to varying mechanical properties in the sintered state. Another drawback of admixed powders is their tendency to dust especially if the alloying element is present in the form of very small particles.

In fully prealloyed powders segregation is not an issue because every particle has the same composition. Dusting is less of a concern due to the absence of very fine particles. However, prealloyed powders are much less compressible than admixed powders because of the solid solution hardening effect each alloying element has on the host iron powder.

In spite of the drawbacks, the use of admixed powders has certain advantages over fully prealloyed powders. The mechanical properties of P/M steels are directly related to their density which, in turn, is directly related to the compressibility of the powders making up the steel. In addition, admixed powders are more economical. Copper is always admixed in P/M steels while nickel is preferentially admixed to maintain compressibility of iron powder.

Diffusion alloying of elements to iron powder was the first step taken to alleviate the segregation and dusting concerns in powder mixtures. British Patent 1,162,702 disclosed the idea of partially thermally annealing alloying elements. Today iron powder producers make various iron powder products with alloying elements (e.g. nickel, copper, molybdenum) diffusion alloyed to the surface of the iron. These diffusion-alloyed blends are generally considered high-performance materials and are used when high physical properties need to be attained in the final part. While used extensively in Europe where P/M parts tend to be smaller and require higher performance, the cost of these powders is relatively high and their use is not as widespread in North America, where parts are larger and material cost is a more important factor in finished part cost.

An alternative solution to the debilitating segregation and dusting problems posed by admixed powders has been developed more recently. Organic resin agents are used to bind the various particles together. This development has been refined to the point where resin-bonded iron powders can compete on a performance basis with diffusion-bonded iron powders of similar composition. However, reports of some problems with agglomeration of very fine powder additives to iron powders during resin bonding indicate that very careful processing may be required to maintain product quality in some materials. Although less costly than diffusion-bonded iron powders, resin-bonded iron powders impart extraneous handling and processing steps to admixed iron powders and therefore present a material cost penalty for the P/M parts producer.

The first known patent disclosing resin-bonding (also known as binder-treating) was U.S. Pat. No. 4,483,905. Binders were used to significantly improve the bonding of fine additives (i.e. −44 μm Fe—P) to coarse iron powder and to minimize the segregation of graphite (carbon) in large-scale steel blends. The binding agents preferred in the patent were: polyethyleneglycol, polypropyleneglycol, polyvinylalcohol and glycerol due to their chemical and physical stability (ability to keep particles bound without hardening over time) and their ability to be burnt off easily during the sintering operation.

U.S. Pat. No. 4,834,800 identified other agents suitable for binder-treated iron powders using a similar process. The patent focused on the use of water-insoluble polymeric resins as the preferred agents.

U.S. Pat. No. 5,069,714 selected one specific binding agent, polyvinyl pyrrolidone (PVP), which was not mentioned in any previous binder-treatment patents, and describes a solvent-based process for carrying out the binder-treatment process.

Currently, standard nickel-copper P/M steels are prepared by placing iron powder, graphite carbon, nickel powder, copper powder and lubricant powder in the appropriate ratios by weight (usually 1-4% nickel, 1-3% copper, 0.2-1.0 graphite, 0.75% wax, balance iron) into a container and mixing the resultant powder mixture until well blended (usually 30 to 45 minutes for a total powder mass up to 10 tonnes).

Alternatively, the P/M industry employs the use of bonded iron powder products, such as high performance diffusion-bonded iron powders and resin-bonded iron powders. In these materials iron and the alloying elements have already been combined, so only lubricant and graphite carbon are added to the blend prior to consolidation into a green part. Some commercial hybrid iron powder products have some of the alloying elements prealloyed such as molybdenum, chromium and manganese, while other elements are admixed (graphite), diffusion-bonded (Ni, Cu, Mo), or resin-bonded onto iron (Ni, Cu, graphite carbon).

The powder mixture is then compacted (typical pressures of 400-700 MPa) in a die to form a green compact and then the compact is sintered at elevated temperatures (1100-1250° C.) for 2045 minutes in a reducing atmosphere (e.g. 95/5 $N_2/H_2$).

Studies done by some of the present co-inventors (Singh, et al. "Nickel-Copper Interactions in P/M Steels." *Advances in Powder Metallurgy & Particulate Materials*-2004, Metal Powder Industries Federation, December 2004, presented at the June 2004 International Conference on Powder Metallurgy and Particulate Materials in Chicago, Ill.) have shown that improving the distribution of nickel in nickel-copper steels via the use of finer nickel powder also improves the distribution of copper. As copper melts during sintering of steels, the affinity of nickel and copper for each other affects the distribution of copper in the sintered steel. Overall, the improved distribution of nickel and copper obtained with finer nickel powder gives better properties in the final steel part, including significantly improved dimensional control (reduction in part swelling and reduction in part-to-part variation of size change), and improved mechanical properties (higher flexural strength, hardness, tensile strength and lower part-to-part variation of mechanical properties).

Finer nickel powders therefore provide a means for increasing the interaction between nickel and copper as well as improving the distribution of these alloying elements in the sintered steel. While standard grades of copper powder used commercially in the ferrous P/M industry are relatively coarse (eg. −165 mesh) compared to nickel, the benefits in using a finer copper powder are well known. Large pores left by coarse copper powder after melting during sintering of steels negatively impacts on mechanical properties, particularly the dynamic properties of steels. However, as noted previously, the cost of atomized copper powder increases dramatically as the mean particle size approaches 10 micrometers due to low yield. Iron powder producers have circumvented the high cost of fine copper powders in diffusion-bonded iron powder products by employing fine copper oxide and coreducing during the diffusion bonding process. Fine copper oxide can be made economically, as brittle materials can be readily ground to fine particle size. However, fine copper oxide powder has not been used in admixed or resin-bonded iron powders due to poor compressibility and the need for additional carbon to reduce copper during sintering, lowering green density of the compact. While relatively coarse oxide reduced copper powder is commonly used by the P/M industry, there does not appear to have been any attempt to reduce fine copper oxide powder prior to incorporation in either admixed or resin-bonded iron powders, presumably due to caking of the reduced powder and loss of discrete particles, as well as the additional cost and complication of an additional processing operation.

The benefit in the use of fine nickel and copper powders in P/M steels has been demonstrated. However, there is an additional benefit that has been observed in the development of the present invention by placing nickel and copper powders in close proximity to each other. When present in relatively low quantities in the steel, typically less than about 4 wt % Ni and 2 wt % Cu, the opportunity for nickel and copper to interact with each other is limited to the migration of liquid copper to solid nickel during the latter stages of the sintering process. In admixed powder steels, the simple order of addition of powders to the blender can have an effect on the interaction between alloying elements. As part of the present invention, by premixing nickel and copper powders the inventors obtained improvements in properties of sintered steels compared to standard admixing, whereby constituent powders are added at the same time and then blended.

The present invention seeks to provide a means by which this interaction between nickel and copper particles can be enhanced. In particular, by increasing the proximity of nickel and copper particles through the provision of a stable, transportable nickel-copper powder this desired interaction can be further increased.

There is therefore a need for a bonded nickel-copper powder additive for P/M steels that enhances the properties of the P/M steels while eliminating the difficulties posed by current admixed powders or pre-alloyed iron powders.

SUMMARY OF THE INVENTION

There is provided a thermally bonded nickel-copper precursor powder for use in P/M steels and alloys. The powders are bonded together thermally through the interdiffusion of copper and nickel, by preferably annealing them in a reducing atmosphere at about 400-700° C. for about 3040 minutes to create a powder in which nickel and copper are intimately associated ("stuck to each other") or "diffusion bonded" but not fully alloyed since complete alloying of nickel and copper would cause the resulting particles to become very hard and impair compressibility of the green P/M compact.

The bonded nickel-copper precursor powder is then added to the iron-carbon steel master powders for subsequent mixing, consolidation and sintering to form a P/M steel part. Alloy P/M parts are similarly produced.

PREFERRED EMBODIMENTS OF THE INVENTION

The adverb "about" before a series of values will be construed as being applicable to each value in the series unless noted to the contrary.

As noted previously the dimensional change behavior of P/M nickel-copper steels depends in part on the particle size of both nickel and copper powders, as well as the uniformity in distribution of these elements. The mechanical properties of nickel-copper steels are in turn affected by these factors and by the degree to which copper and nickel interact during sintering.

In order to test and confirm the concept that a diffusion-bonded nickel-copper powder additive results in a superior P/M product while eliminating the issues surrounding conventional industrial practice, a number of samples were produced and their characteristics tested.

Production of Diffusion Bonded ("DB") Powders

Nickel powder (1-100 μm) is combined with a copper powder or (unreduced) copper oxide powder (1-100 μm) in an appropriate wt % ratios (depending on the final content that is desired in the metal component). Preferred Ni:Cu wt % ratios range from about 1:1-4:1.5. The nickel-copper oxide mixture is mixed for several minutes (10-30 minutes.) in a standard P/M type mixer (V-cone, multi-axis, double cone, etc.). Copper oxide is preferred over copper powder because of the active surface provided by the reduction of the oxide. This active surface not only improves bonding efficiency between nickel and copper particles, but it also retards the alloying (and subsequent particle hardening) of nickel and copper during the diffusion-bonding process.

The nickel-copper oxide mixture is placed (as a loosely packed bed) into a ceramic crucible and put into a sintering furnace at an elevated temperature. The temperature range preferred is about 400° C.-700° C. The diffusion-bonding temperature depends mainly on the initial oxygen content of the copper oxide, as well as the nickel and copper oxide particle size. In general, it is preferable to use as low a DB temperature as possible that will allow the final oxygen content of the DB powder to be below 5%. Oxygen contents greater than 5% in the DB powder strongly deteriorate the green density and and mechanical integrity of the steel (assuming a 4% DB Ni—Cu addition to steel). Further, oxygen contents below 0.5% in the DB Ni—Cu powder are preferred as green density is not negatively affected at this level. A preferred atmosphere of the furnace is about $95N_2$-$5H_2$. If the % $H_2$ in the furnace is greater than 10%, the particles of copper oxide will become very hard and unmillable. The preferred time of diffusion-bonding is about 20-60 minutes.

The powder is caked up (and often hardened) following the DB process. A light hammer milling action (e.g. via mortar and pestle) may be applied to increase the fineness of the powders. As an example, a 90% yield of DB 50Ni-50Cu powder after milling had a d50 particle size of approximately 30 μm with a starting nickel powder d50 size of 8 μm and copper oxide (20wt % $O_2$) particle size of 5 μm. In general, the lower the DB temperature, the finer are the particles of the resulting powder.

EXAMPLES

Example 1

Effect of Premixing

Two mixtures of a P/M steel powder with the following composition were prepared:

| Powder | Addition |
|---|---|
| Carbon (Southwestern ™ 1651) | 0.6% |
| Lubricant (Lonza Acrawax ™ C) | 0.7% |
| Copper (ACuPowder ™ 165) | 2% |
| Nickel (INCO ® T123) | 2% |
| Iron (QMP ™ AT1001) | balance |

In Mixture #1, all of the powder components were put into a mixing container at the same time and mixed (using a Turbula™ T2F multi-axis mixer) for 30 minutes.

In Mixture #2, nickel and copper powders were prerixed for 20 minutes and this nickel-copper premix was added to the rest of the powder components and mixed for 30 minutes.

Standard test samples from each mixture (Steel #1 and 2 from Mixtures #1 and 2 respectively) were pressed at 550 MPa compaction pressure and sintered at 1120° C. for 30 minutes in a 95/5 $N_2/H_2$ atmosphere. Results of the tests associated with these mixtures are shown in Table 1. ("TRS" is tranverse rupture strength. "UTS" is ultimate tensile strength. "HRB" is Rockwell B hardness.)

TABLE 1

| | Density | | Dimensional Change | | Physical Properties | | | |
|---|---|---|---|---|---|---|---|---|
| Steel | Green (g/cc) | Sintered (g/cc) | Mean % Dimensional Change | Standard Deviation (10^ −2) | Mean TRS (MPa) | Hardness (HRB) | UTS (MPa) | % Elongation |
| 1 | 6.99 | 7.01 | 0.77 | 8.71 | 730 | 73 | 410 | 1.3 |
| 2 | 6.99 | 7.01 | 0.63 | 6.26 | 750 | 74 | 430 | 1.3 |

Example 2

Effect of Fineness of Ni Powder on Premixed Steels

Two P/M steel powders (prepared via the premixed nickel-copper method described in Mixture #2 of Example 1) of the following composition were prepared:

| Powder | Addition |
|---|---|
| Carbon (Southwestern 1651) | 0.6% |
| Lubricant (Lonza Acrawax C) | 0.7% |
| Copper (ACuPowder 165) | 2% |
| Nickel | 2% |
| Iron (QMP AT1001) | balance |

In Mixture #1 INCO Type 123 nickel powder (standard size, 8 μm d50) was used, while in Mixture 2 INCO Type 110 (extra-fine size, 1.5 μm d50) was used.

Standard test samples from each mixture (Steel #1 and 2 from Mixtures #1 and 2 immediately above respectively) were pressed at 550 MPa compaction pressure and sintered at 1120° C. for 30 minutes in a 95/5 $N_2/H_2$ atmosphere. Results of the tests associated with these mixtures are shown in Table 2.

TABLE 2

| | Density | | Dimensional Change | | Physical Properties | | | |
|---|---|---|---|---|---|---|---|---|
| | | | Mean % | Standard | | | | |
| Steel | Green (g/cc) | Sintered (g/cc) | Dimensional Change | Deviation (10^ −2) | Mean TRS (MPa) | Hardness (HRB) | UTS (MPa) | % Elongation |
| 1 | 6.99 | 7.01 | 0.63 | 6.2 | 750 | 74 | 430 | 1.3 |
| 2 | 7 | 7.03 | 0.27 | 4.9 | 930 | 76 | 530 | 1.3 |

Example 3

Effect of DB'ing

Two P/M steel powders of the following composition were prepared:

| Powder | addition |
|---|---|
| Carbon (Southwestern 1651) | 0.6% |
| Lubricant (Lonza Acrawax C) | 0.7% |
| Copper | 2% |
| Nickel (INCO T123) | 2% |
| Iron (QMP AT1001) | balance |

Mixture #1 was prepared via the nickel-copper premix method (as described for Mixture #2 in Example 1) using ACuPowder 165 copper powder.

Mixture #2 was prepared by adding diffusion-bonded nickel-copper powder. Aldrich™ CuO (20 wt % $O_2$) was mixed with nickel powder (INCO T123) to give a 1:1 copper:nickel ratio. The resulting nickel-copper mixture was then diffusion-bonded at 550° C. for 40 minutes in a 95/5 $N_2/H_2$ atmosphere. The DB Ni—Cu powder was then milled and screened to <63 μm. The screened fraction was added to the other powder components and mixed (as in Mixture #1 immediately above).

Standard test samples from each mixture (Steel #1 and 2 from Mixtures #1 and 2 immediately above respectively) were pressed at 550 MPa compaction pressure and sintered at 1120° C. for 30 minutes in a 95/5 $N_2/H_2$ atmosphere. Results of the tests associated with these mixtures are shown in Table 3.

TABLE 3

| | Density | | Dimensional Change | | Physical Properties | | | |
|---|---|---|---|---|---|---|---|---|
| | | | Mean % | Standard | | | | |
| Steel | Green (g/cc) | Sintered (g/cc) | Dimensional Change | Deviation (10^ −2) | Mean TRS (MPa) | Hardness (HRB) | UTS (MPa) | % Elongation |
| 1 | 6.99 | 7.01 | 0.63 | 6.2 | 750 | 74 | 430 | 1.3 |
| 2 | 6.96 | 6.98 | 0.29 | 1.4 | 840 | 75 | 510 | 1.3 |

Example 4

Effect of DB Temperature (Using Standard Ni)

Three P/M steel powders (prepared using the nickel-copper diffusion-bonded powder as in Mixture #2 Example 3) with the following composition were prepared:

| Powder | addition |
|---|---|
| Carbon (Southwestern 1651) | 0.6% |
| Lubricant (Lonza Acrawax C) | 0.7% |
| Copper (Aldrich CuO) | 2% |
| Nickel (INCO T123) | 2% |
| Iron (QMP AT1001) | balance |

Mixtures #1, #2 and #3 were prepared with diffusion-bonded powders made at 450° C., 550° C. and 650° C. respectively (the DB Ni—Cu powders had 10.5% , 5.5% and 0.3% oxygen respectively).

Standard test samples from each mixture (Steel #1, 2 and 3 from Mixtures #1, 2 and 3 immediately above respectively) were pressed at 550 MPa compaction pressure and sintered at 1120° C. for 30 minutes in a 95/5 $N_2/H_2$ atmosphere. Results of the tests associated with these mixtures are shown in Table 4.

TABLE 4

| | Density | | Dimensional Change | | Physical Properties | | | |
|---|---|---|---|---|---|---|---|---|
| | | | Mean % | Standard | | | | |
| Steel | Green (g/cc) | Sintered (g/cc) | Dimensional Change | Deviation (10^ −2) | Mean TRS (MPa) | Hardness (HRB) | UTS (MPa) | % Elongation |
| 1 | 6.89 | 6.91 | 0.34 | 2.8 | 720 | 73 | 390 | 0.7 |
| 2 | 6.96 | 6.98 | 0.29 | 1.4 | 840 | 76 | 510 | 1.3 |
| 3 | 6.99 | 7.01 | 0.35 | 4.84 | 830 | 74 | 510 | 1.3 |

Example 5

Effect of Oxygen Content of Starting CuO Powder

Two P/M steel powders were prepared using the nickel-copper diffusion-bonded powder (as in Mixture #2 Example 3, DB @550° C.). The mixtures had the following compositions:

| Powder | Addition |
|---|---|
| Carbon (Southwestern 1651) | 0.6% |
| Lubricant (Lonza Acrawax C) | 0.7% |
| Copper | 2% |
| Nickel (INCO T123) | 2% |
| Iron (QMP AT1001) | balance |

In Mixture #1, Aldrich CuO (20 wt % starting 0, 5 μm d50) was used in the diffusion-bonding process, which was done 550° C. In Mixture #2, ACuPowder unreduced Cu (10 wt % initial oxygen, 5 μm d50) was used in the diffusion-bonding process, which was also done at 550° C. The oxygen contents of the DB Ni—Cu powders were 5.5% and 0.2% for Mixture #1 and #2 respectively.

Standard test samples from each mixture (Steel #1 and 2 from Mixtures #1 and 2 immediately above respectively) were pressed at 550 MPa compaction pressure and sintered at 1120° C. for 30 minutes in a 95/5 $N_2/H_2$ atmosphere. Results of the tests associated with these mixtures are shown in Table 5.

TABLE 5

| | Density | | Dimensional Change | | Physical Properties | |
|---|---|---|---|---|---|---|
| | | | Mean % | Standard | Mean | |
| Steel | Green (g/cc) | Sintered (g/cc) | Dimensional Change | Deviation (10^ −2) | TRS (MPa) | Hardness (HRB) |
| 1 | 6.96 | 6.98 | 0.29 | 1.4 | 840 | 76 |
| 2 | 6.97 | 6.99 | 0.27 | 1.3 | 990 | 78 |

Example 6

Effect of Fineness of Ni Powder on DB Steels

Two P/M steel powders were prepared using the nickel-copper diffusion-bonded powder (as in Mixture #2 Example 3, DB @ 550° C.). The mixtures had the following compositions:

| Powder | Addition |
|---|---|
| Carbon (Southwestern 1651) | 0.6% |
| Lubricant (Lonza Acrawax C) | 0.7% |
| Copper (ACuPowder CuO) | 2% |
| Nickel | 2% |
| Iron (QMP AT1001) | balance |

In Mixture #1 INCO Type 123 nickel powder (standard size, 8 μm d50) was used, while in Mixture 2 INCO Type 110 nickel powder (extra-fine size, 1.5 μm d50) was used.

Standard test samples from each mixture (Steel #1 and 2 from Mixtures #1 and 2 immediately above respectively) were pressed at 550 MPa compaction pressure and sintered at 1120° C. for 30 minutes in a 95/5 $N_2/H_2$ atmosphere. Results of the tests associated with these mixtures are shown in Table 6.

TABLE 6

| | Density | | Dimensional Change | | Physical Properties | |
|---|---|---|---|---|---|---|
| | | | Mean % | Standard | Mean | |
| Steel | Green (g/cc) | Sintered (g/cc) | Dimensional Change | Deviation (10^ −2) | TRS (MPa) | Hardness (HRB) |
| 1 | 6.97 | 6.99 | 0.27 | 1.3 | 990 | 78 |
| 2 | 6.95 | 6.96 | 0.22 | 0.5 | 980 | 78 |

Example 7

Effect of DB Temperature Using Extra-Fine Ni

Two P/M steel powders were prepared using the nickel-copper diffusion-bonded powder (as in Mixture #2 Example 3, DB @ 550° C.). The mixtures had the following compositions:

| Powder | addition |
|---|---|
| Carbon (Southwestern 1651) | 0.6% |
| Lubricant (Lonza Acrawax C) | 0.7% |
| Copper (ACuPowder CuO) | 2% |
| Nickel (INCO T110) | 2% |
| Iron (QMP AT1001) | balance |

Mixtures #1 and #2 were prepared with diffusion-bonded powders made at 550° C., 450° C. respectively (the DB Ni—Cu powders had 0.3% and 0.2% $O_2$ respectively).

Standard test samples from each mixture (Steel #1 and 2 from Mixtures #1 and 2 immediately above respectively)

were pressed at 550 MPa compaction pressure and sintered at 1120° C. for 30 minutes in a 95/5 $N_2/H_2$ atmosphere. Results of the tests associated with these mixtures are shown in Table 7.

TABLE 7

| | Density | | Dimensional Change | | Physical Properties | |
|---|---|---|---|---|---|---|
| Steel | Green (g/cc) | Sintered (g/cc) | Mean % Dimensional Change | Standard Deviation (10^-2) | Mean TRS (MPa) | Hardness (HRB) |
| 1 | 6.95 | 6.96 | 0.22 | 0.8 | 980 | 78 |
| 2 | 6.98 | 7.01 | 0.23 | 1.0 | 1050 | 79 |

Advantages of preparing and using the diffusion bonded nickel-copper powders are borne out by the following conclusions:

1. In sintered steels containing nickel and copper, nickel and copper have a very strong affinity for each other due to high diffusion coefficients between them, complete solid solubility for each other, similar crystal structure and atomic mass.

2. Premixing of nickel and copper to make a Ni—Cu master mix increases the interaction of nickel and copper during sintering. Thus, by improving the distribution of one of the powders (e.g. using finer nickel powder) an improvement in the distribution of the other can be obtained. Better distribution results in more uniform diffusion in the steel during sintering which leads to an improvement in dimensional precision properties and mechanical properties.

3. Fine copper oxide powder can be thermally bonded to Ni powder, with the resulting diffusion-bonded (DB) powder capable of enhancing the interaction of nickel and copper even more so than by premixing them. The result is a significant improvement in the properties of sintered steels with DB Ni—Cu additions compared to standard admixed copper and nickel powder additions.

4. P/M steels using the DB powders had substantially improved dimensional consistency and reduced swelling during sintering process over standard and premixed steels of the same composition. In addition, the steels which used the DB powder additions possessed significantly better mechanical properties than steels of the same composition made by the standard and premix processes.

5. Annealing can take about 1 to 120 minutes. Annealing heat treatment times are a function of the annealing temperatures. High temperatures should be avoided to prevent loss of particle surface energy and sintering activity with iron. Higher temperatures will require shorter treatments to avoid complete alloying of the elements. This should be avoided since complete alloying hardens the particles which in turn renders them less compressible.

6. The DB (annealing) temperature can range from about 100-1100° C. This depends on several factors including the initial oxygen content of the copper oxide and the particle sizes of the nickel and copper. In general, DB temperatures should be kept to the minimum that will allow final oxygen content in the DB powder of less than 0.5%. Assuming a copper oxide particle size of 5 μm and an annealing time of 40 minutes, 550° C. DB gave optimum results when using a standard P/M nickel powder (d50~8 μm) while 450° C. DB gave optimum results when using an extra-fine nickel powder (d50~1.5 μm).

7. The composition of the diffusion bonded powders may vary in a range from about 1% nickel-99% copper to 99% nickel-1% copper depending on the P/M steel target. While the above tests used a 50% nickel-50% copper powder ratio, the preferred Ni:Cu ratio ranges from about 1:1-4:1.

8. The starting nickel materials may be nickel powder, nickel oxide, nickel flake, etc. Particle sizes should be equal to or less than about 100 μm with less than about 10 μm preferred.

9. The starting copper materials may be copper powder, copper oxide, copper flake, etc. Particle sizes should be equal to or less than about 100 μm with less than about 10 μm preferred. Copper oxide is preferred as the oxygen surface allows for better bonding and keeps the powder from overhardening during heating.

10. Other metal-based powders such as molybdenum, $MoO_3$, ferromolybdenum, ferrochrome, ferromanganese, and ferrophosphorus may be diffusion bonded to the original individual nickel and/or copper to make a variety of diffusion bonded powders.

11. Based upon results for a 550° C. annealing treatment, a time of about 30-40 minutes is preferred. Higher temperatures require shorter DB times to avoid the debilitating loss of compressibility.

While the above examples demonstrate performance improvements using diffusion-bonded nickel-copper powders in plain iron powder steels, those skilled in the art will recognize that these performance benefits would also be expected in hybrid steels and alloys, i.e., iron powders prealloyed with elements such as Mo, Cr and Mn. The diffusion-bonded nickel-copper additive of the present invention may be added to any powder metallurgy master blend. A further extension of these examples includes the use of fugitive organic binding agents such as polyvinyl acetate, methyl cellulose, vinyl acetate, alkyd resins, and polyester resins to improve the contact between nickel and copper oxide particles prior to annealing, thereby increasing the bonding efficiency of the diffusion bonding process.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

What is claimed is:

1. A diffusion bonded nickel-copper precursor powder suitable for use in powder metallurgy steels and alloys, the diffusion bonded nickel-copper precursor powder including nickel and copper ranging from 1% to 99% weight percent respectively wherein the size of the nickel and copper are equal to or less than about 100 μm and wherein the diffusion bonding of the nickel and copper occurs for about 1-120 minutes at about 100-700° C.

2. The diffusion bonded powder according to claim 1 wherein the nickel is selected from at least one from the group consisting of metallic nickel powder, nickel oxide powder and nickel oxide flake and the copper is selected from at least one from the group consisting of metallic copper powder, copper oxide powder and copper oxide flake.

3. The diffusion bonded powder according to claim 1 wherein the size of the nickel and copper are equal to or less than about 10 μm.

4. The diffusion bonded powder according to claim 1 wherein diffusion bonding of the nickel and copper occurs for about 20-60 minutes at about 400-700° C.

5. The diffusion bonded powder according to claim 4 wherein diffusion bonding of the nickel and copper occurs at about 550° C. for about 30-40 minutes.

6. The diffusion bonded powder according to claim 1 wherein diffusion bonding occurs in a reducing environment.

7. The diffusion bonded powder according to claim 1 wherein the nickel to copper ratio ranges from about 4:1.5 to 1:1.

8. A method for making a precursor powder additive mixture for powder metallurgy steels and alloys, the method comprising:

a) providing nickel having a size equal to or less than about 100 μm;

b) providing copper having a size equal to or less than about 100 μm;

c) mixing the nickel and copper;

d) diffusion bonding the nickel and copper at about 100-700° C. for about 1-120 minutes into the precursor powder additive mixture adapted for addition to the powder metallurgy steels and alloys.

9. The method according to claim 8 wherein the nickel is selected from at least one of the group consisting of powder, oxide and flake.

10. The method according to claim 8 wherein the copper is selected from at least one of the group consisting of powder, oxide and flake.

11. The method according to claim 8 wherein the size of nickel and copper is individually or jointly equal to or less than about 10 μm.

12. The method according to claim 8 wherein the nickel and copper are diffusion bonded for about 20-60 minutes and at about 400-700° C.

13. The method according to claim 8 wherein the nickel and copper are diffusion bonded at about 550° C. for about 30-40 minutes.

14. The method according to claim 8 including adding the mixture to powder metallurgy steels and alloys selected from at least one of the group consisting of molybdenum, chromium, manganese, molybdenum trioxide, fenumanganese, ferrochrome, ferromolybdenum, and ferrophosphorous.

15. The method according to claim 8 wherein the nickel and the copper ratio ranges from about 4:1.5 to 1:1.

16. The method according to claim 8 including adding the diffusion bonded nickel and copper mixture to a powder metallurgy master blend.

17. The method according to claim 8 wherein diffusion bonding of the precursor mixture occurs in a reducing environment.

18. The method according to claim 17 wherein diffusion bonding of the precursor mixture occurs in an atmosphere of about 95% nitrogen and 5% hydrogen.

19. The method according to claim 8 including adding a binder to the mixture.

20. The method according to claim 19 wherein the binder is selected from at least one of the group consisting of polyvinyl acetate, methyl cellulose, vinyl acetate, alloyed resins and polyester resins.

21. A method for making powder metallurgy products, the method comprising:

a) providing a diffusion bonded nickel-copper precursor mixture wherein the nickel-copper precursor mixture is diffusion bonded for about 1-120 minutes at about 100-700° C. and the nickel to copper ratio of the precursor mixture ranges from about 4:1 to 1:1 and the size of the nickel is about equal to or less than 100 μm and the size of the copper is about equal to or less than 100 μm and the nickel is about 1-99% weight percent and the copper is about 99-1% weight respectively of the nickel-copper precursor mixture, b) providing an iron-based steel metallurgy master powder, c) adding the diffusion bonded nickel-copper precursor mixture to the iron- based steel metallurgy master powder to form a powder blend, d) mixing the powder blend, e) consolidating the powder blend, and f) sintering the powder blend to generate a powder metallurgy product of selected shape.

22. The method according to claim 21 wherein the nickel is selected from at least one of the group consisting of powder, oxide and flake and the copper is selected from at least one of the group consisting of powder oxide and flake.

23. The method according to claim 21 wherein the diffusion bonded nickel-copper precursor mixture is added to powder metallurgy steels and alloys selected from at least one of the group consisting of molybdenum, chromium, manganese, molybdenum trioxide, ferromanganese, ferrochrome, ferromolybdenum and ferrophosphorous.

24. The method according to claim 21 wherein the size of the nickel and the size of the copper are equal to or less than about 10 μm.

25. The method according to claim 21 wherein the nickel-copper precursor mixture is diffusion bonded for about 20-60 minutes at about 400-700° C.

26. The method according to claim 21 wherein the nickel-copper precursor mixture is diffusion bonded for about 30-40 minutes at about 550° C.

27. The method according to claim 21 wherein diffusion bonding of the precursor mixture occurs in a reducing environment.

28. The method according to claim 27 wherein diffusion bonding of the precursor mixture occurs in an atmosphere of about 95% nitrogen and 5% hydrogen.

29. The method according to claim 21 including adding a binder to the precursor mixture.

30. The method according to claim 29 wherein the binder is selected from at least one of the group consisting of polyvinyl acetate, methyl cellulose, vinyl acetate, alloyed resins and polyester resins.

31. The method according to claim 21 wherein the nickel and copper constitute about 2% respectively of the powder blend.

32. The method according to claim 21 wherein the metallurgy master powder is iron.

33. The method according to claim 21 wherein the metallurgy master powder is an alloy.

34. The method according to claim 21 wherein the metallurgy master powder is steel.

35. The method according to claim 21 wherein the metallurgy master powder is hybrid steel.

* * * * *